United States Patent [19]

Heckel

[11] 4,063,635

[45] Dec. 20, 1977

[54] SUPPLY BIN AND FEEDER SYSTEM COMBINATION FOR TEXTILE COPS OR PIRNS

[75] Inventor: René Heckel, Horgen, Switzerland

[73] Assignee: Maschinenfabrik Schweiter AG, Horgen, Switzerland

[21] Appl. No.: 746,406

[22] Filed: Dec. 1, 1976

[30] Foreign Application Priority Data

Dec. 18, 1975 Switzerland ..... 16418/75

[51] Int. Cl.[2] ..... B65G 47/00

[52] U.S. Cl. ..... 198/531; 198/533; 221/201; 221/205; 221/250; 242/35.5 A; 139/245

[58] Field of Search ..... 198/443, 453, 483, 491, 198/492, 525, 526, 530–533, 550, 616; 57/52, 54; 221/201, 202, 204, 205, 250, 251, 270; 242/35.5 A; 139/245, 250

[56] References Cited

U.S. PATENT DOCUMENTS

| | | | |
|---|---|---|---|
| 2,546,986 | 4/1951 | Dressler | 221/250 |
| 3,276,566 | 10/1966 | Raasch | 198/443 |
| 3,430,810 | 3/1969 | Baller et al. | 221/205 |
| 3,777,932 | 12/1973 | Matsui et al. | 221/204 |

FOREIGN PATENT DOCUMENTS

| | | | |
|---|---|---|---|
| 18,059 | 8/1965 | Japan | 242/35.5 A |

*Primary Examiner*—Evon C. Blunk
*Assistant Examiner*—Joseph E. Valenza
*Attorney, Agent, or Firm*—Flynn & Frishauf

[57] ABSTRACT

To permit single-basket conveyor transport of textile cops from a supply bin holding a number of cops, without damage to the thread wound on the cops upon removal of an individual cop and introduction into the conveyor, the supply bin is constructed such that at least a portion of the bottom thereof is inclined forwardly towards a removal opening leading to the conveyor, and includes a movable base plate which is mounted for movement between a feed position in which the base plate is inclined towards the opening and a re-supply position in which the movable portion is inclined upwardly and away from the removal opening; an ejector is provided having a movable ejector element and occupying a space at least approximately the size of the geometric outline of a cop, the ejector element pushing against the cop and pushing the selected cop for removal through the removal opening against a spring-loaded flap, the ejector element, due to its size, blocking contact between the cop being ejected and a next adjacent cop, while permitting feeding a next following cop into removal position upon withdrawal of the ejector element, preferably downwardly and below the bottom of the inclined portion of the supply bin.

12 Claims, 5 Drawing Figures

SUPPLY BIN AND FEEDER SYSTEM COMBINATION FOR TEXTILE COPS OR PIRNS

Cross-reference to related applications and patents, assigned to the assignee of the present application:

U.S. Pat. Nos. 3,380,677, Stapfer; 3,608,843, Seidlich;

U.S. Ser. No. 308,875, filed Nov. 8, 1972, Heckel — abandoned in favor of U.S. Ser. No. 707,348, filed July 21, 1976;

U.S. Ser. No. 697,943, filed June 21, 1976, now U.S. Pat. No. 4,036,444 Suter;

U.S. Ser. No. 697,944, filed June 21, 1976, now U.S. Pat. No. 4,036,353 Suter.

The present invention relates to an automatic feed or conveyor system for textile cops in combination with a supply bin from which individual textile cops or pirns are separately removed, and more particularly to such a system and combination in which a large number of textile cops or pirns are stored in a storage bin, piled on top of each other.

Various types of storage bins have been proposed; the difficulty arises that misalignment of cops or pirns within the storage bin may cause the formation of bridges and thus failure of cops or pirns to be removed. Additionally, if the number of cops or pirns which are stacked in the bin is large, damage to the thread wound on the cops or pirns may result.

One type of textile cop supply holder is shown in U.S. Pat. No. 3,126,923. According to the structure described in this patent, the lowermost one of the cops or pirns is removed, so that the lowermost one cop is subjected to the weight of the entire stack of cops or pirns. The stack of cops or pirns presses the lowermost cop through a removal opening. Thereafter, and when the cop has been removed, the remaining stack collapses uncontrolled. Jams may result or the formation of bridges by cops which are not perfectly aligned. To prevent malfunction, pivoting elements are provided to clear any jams, the pivoting elements acting on the stack of cops.

It has also been proposed to remove cops or pirns from the topmost level; for example, as shown in German Patent Publication DT-AS No. 1,126,810, or Austrian Patent Oe-Ps No. 289,603. A pusher element pushes the topmost cop from a supply bin. This system requires a pusher element which has a feed travel extending at least across the entire length of a cop, the pusher element necessarily having to penetrate through the entire stack of cops.

All the known removal elements have in common that, upon removal of a single cop, substantial movement results within the remaining cops or the stack of cops left in the storage bin. This movement can lead to damage of the sensitive and carefully wound windings on the cops, particularly if the filament wound thereon is of fine gauge. The difficulty is particularly acute if the cops are to be transported to an automatic spooling machine having an automatic system to join the filament of a new cop to that of an old one which is being spooled by means of a knotting apparatus. Such automatic spooling machines, in one embodiment, have vacuum apparatus to remove the free end or foot lap from the cop to introduce this foot lap to the knotting apparatus of the spooling machine. If the foot laps are pressed into the windings of the filament on the cop by pressure, or friction from other cops, difficulty or impossibility of automatic removal of the foot lap may result, thus leading to malfunction of the spooling machine and interference with its automatic operation.

It is an object of the present invention to provide a removal apparatus and system for combination with a storage bin in which textile spool holders such as textile cops or pirns, shuttle thread spools, and the like, can be removed from a supply bin, and in which the removal of the filament holder is effected gently and while protecting the winding of the filament, yarn or thread on the filament holder.

SUBJECT MATTER OF THE PRESENT INVENTION

Briefly, at least a portion of the bottom of the supply bin is inclined forwardly towards a removal opening. The bottom includes a movable base plate which is mounted for movement between a feed position, in which the base is inclined in the direction of the opening to direct the cop towards the opening, and a re-supply position in which the base inclined upwardly and away from the removal opening. An ejector is movable to engage a cop and push it through the removal opening; the ejector, preferably, occupies a space at least approximately that of the geometric outline of the cop. The ejector moves between a rest position in which the ejector element is located immediately in advance of the cop removal opening, and closing off the opening; a re-supply position in which the ejector is located in a withdrawn position, for example beneath the bottom of the supply bin; and a feed position in which the ejector engages the cop and pushes it so that it will be moved, by gravity, along the bottom of the supply bin and be pushed through the removal opening against a bias force applied to a closing flap closing off the removal opening.

Motor drives are provided to move the respective elements. Preferably, the ejector is pivoted and is moved between its various respective positions by pivoting movement.

The system permits placing the lowermost cop of a stack of cops in a "ready" position, that is, in a holding space where the cop is essentially removed from pressure of the remaining cops in the stack or otherwise located in the bin. Cops which are not in the holding position or holding chamber are spaced therefrom by the movable bottom portion of the base of the bin so that the particular cop being fed through the removal opening is separated from the remainder of the stack and the zone free from pressure due to the stacked cops in the bin will result. The remaining cops in the bin are gently kept away from the holding zone or space in which the cop being next fed through the opening is located. The isolation of this cop being fed can be additionally enhanced by forming the movable base plate of the bottom of the bin in such a way that it acts on the cops adjacent the one being fed partly throughout its circumference, that is, by shaping it in a form of a shoe or partial basket.

The pressure-free holding chamber is additionally enhanced by locating a pivotal, plate-shaped blocking lever arrangement above the removal opening, extending transversely of the holding zone approximately by the width of a cop in the stack, to additionally keep away any cops which might otherwise possibly penetrate towards the holding space or holding chamber.

The lowermost cop can then be removed free from pressure of the remainder of the cops in the bin. The system additionally permits gentle feeding of the next subsequent cop to the holding chamber or zone, by permitting the subsequent cop to slide slowly and gently into the holding chamber. The speed of feed of the next cop to the holding position can be controlled by suitably controlling the reset speed of the movable base plate of the bottom of the bin and further controlling the speed of resetting of the pivotal plate-like locking lever above the removal opening.

The ejector element preferably is formed like a rake or grid with tines, and movable through the bottom base plate which, likewise, is formed with tines and adjacent intermediate slots through which the tines of the ejector may extend. Movement of the ejector to eject a cop is preferably so arranged that it, simultaneously, closes off the ejection opening after the cop has been ejected to prevent possible erroneous feeding of a subsequent cop.

The various movements of the various elements are all commanded mechanically like links, levers and cams engaging a shaft which is driven, preferably in synchronism with the conveyor which removes the ejected cops from the ejection opening.

The invention will be described by way of example with reference to the accompanying drawings, wherein.

Figure 1:
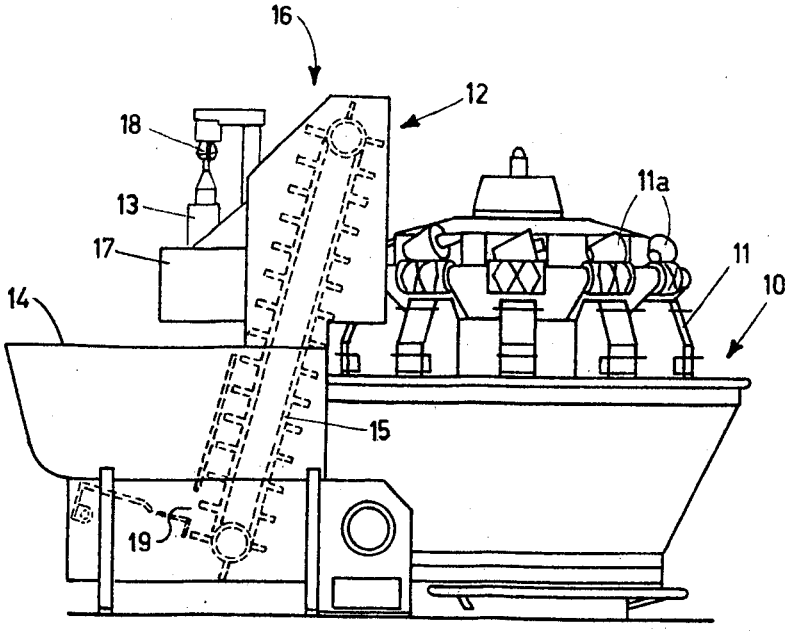
FIG. 1 is a schematic side view of an automatic cross-wound spooling machine and including the arrangement to separately transport textile spinning cops.

The automatic spooling machine has a plurality of spooling positions 11 located around the circumference of a revolvable turret 10, and, as such, is known. Reference is made to the cross-referenced patents and applications. Spinning cops can be received at the lower region of each one of the spooling positions 11. The specific spooling arrangement is not visible. The individual threads, yarns or other filaments from the spinning cops are wound from the cops on yarn packages 11*a* at the spooling positions 11. Empty spinning cops can be exchanged by rotation of the turret 10 and by association of the empty position with an interrupt-resume automatic system 12. The interrupt-resume automatic system 12 has a rotatable magazine in which compartments are arranged for separate, isolated spinning cops from which end foot laps extend. The magazines can be automatically loaded. To supply the magazine with spinning cops, a bin 14 is provided from which spinning cops are separately removed and conveyed by a conveyor 15 to the automatic system 12. Transport of the spinning cops extends up to a removal position 16, at which the spinning cops are removed, for example by grippers 18 and carried to a cop preparation station 13 for removal of the foot lap and preparation of the cop for insertion into the respective compartments of the magazine. A filling station 17 then introduces the cops into respective empty compartments or positions in the magazine.

The overall automatic spooling machine uses a plurality of separate elements and units, which are described in the cross-referenced patents and applications. The problem to be solved by the present invention is related specifically to removal of cops from the bin 14 and placing then singly on the conveyor 15, an operation which should be carried out without damage to the cops, gently, and reliably. The lowermost one of a number of spinning cops placed in the bin 14 is removed through a removal opening 19 to then slide into an open compartment or basket of conveyor 15 which is formed as a compartmented conveyor chain.

Figure 2:
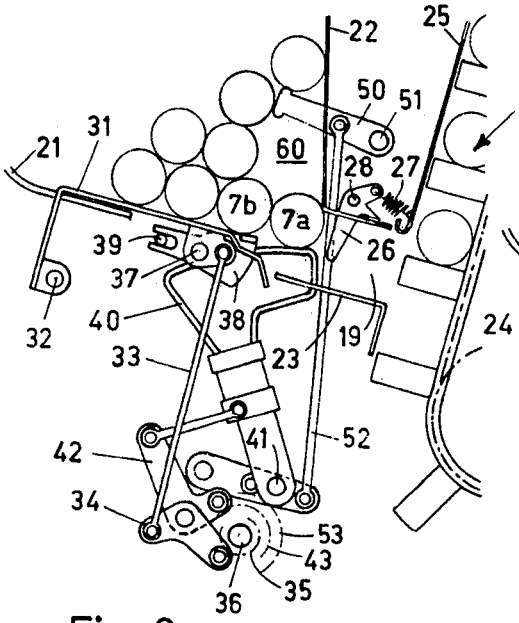
FIG. 2 is a schematic side view showing the region of removal of a cop and insertion of the cop into a conveyor, and the mechanism in connection therewith in a position just before a cop is permitted to enter the removal zone in advance of the ejection openings.

Referring to FIG. 2: Bin 14 is defined by fixed wall portions 21, 22, 23, as well as by lateral wall portions not seen in FIG. 2. Portion 21 forms part of the bottom of the bin; portions 22, 23 define, in part, the removal opening 19. The respective compartments 24 of the cop conveyor 15 pass by the removal opening 19. The compartments 24 are then guided behind a fixed cover plate 25 after a cop has been placed into a respective compartment of the conveyor 15.

The entire machine, including the bin, has a frame structure, not separately shown, and resting on the floor on which the machine is also placed. It is to be understood that the wall portions 21, 22, 23, as well as cover plate 25 or other elements not specifically connected to each other are secured to such a fixed frame, or frame members connected thereto.

The removal opening 19 can be closed by a flap 26 which is rotatable outwardly, that is, in counterclockwise direction (FIG. 2). It is biassed to closed position by a reset spring 27. The flap 26, preferably in form of an elongated plate, is pivoted by a pin 28. Other bias arrangements holding the flap 26 in biassed, closed position may be used.

Figure 3:
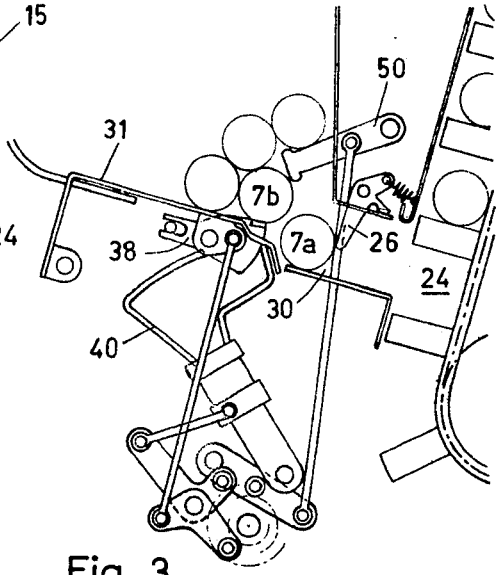
FIGS. 3, 4 and 5 illustrate the mechanism of FIG. 2 in sequential operating positions, with reference numerals assigned to those portions which change position, for clarity, and to render the sequential changes in positions of the various elements better visible.

As best seen in FIG. 3, flap 26 holds a cop 7*a*, located in the holding, "ready" position, and prevents the cop 7*a* from rolling outwardly. Thus, the cop 7*a* cannot yet be removed through opening 19. Removal is effected only if the bottom or basket of a compartment 24 of conveyor 15 becomes flush with a guide surface on which the cop 7*a* can slide or roll to gently fit into an open compartment 24 of conveyor 15.

The space in which a cop 7 *a* is located prior to removal may be termed the "holding" space or "ready" space, or chamber. This chamber 30 is formed by the lower wall portion 23, beneath the removal opening 19, and by a base plate 31 forming a portion of the bottom 21 of the wall of the bin. Portion 31 is stepped downwardly to thereby contribute to the formation of the proper size of the "holding" or "ready" space or chamber 30.

The bottom portions 21, 31, as well as the portion 23 beneath the removal opening 19 are downwardly inclined with respect to the direction of movement of a cop from the bin 14 to the conveyor 15. Thus, cops or spools in the bin 14 can move by gravity to conveyor 15.

Figure 4:
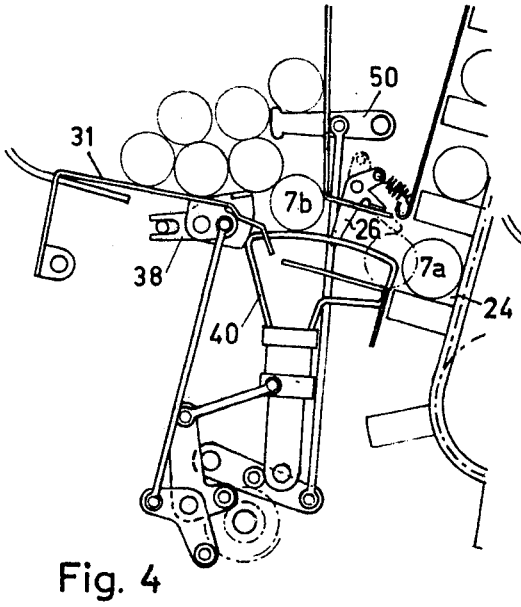
Figure 5:
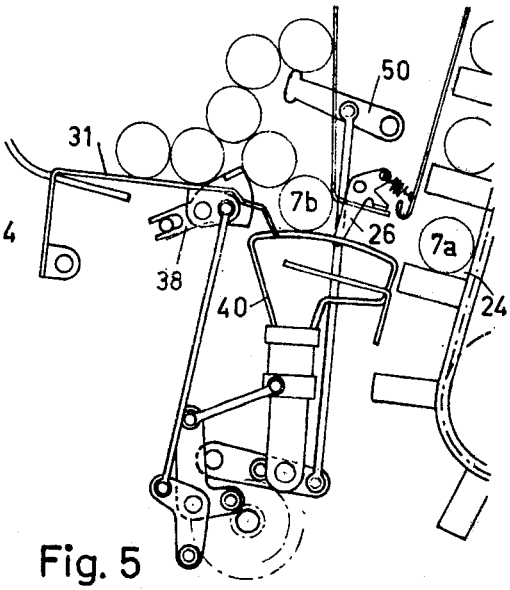

The bottom plate 31 of the bin 14 is movable. It is pivoted to swing about a fixed shaft 32. To move the bottom plate, a link 33 engages the end of the bottom plate 31 closest to the holding chamber 30. Link 31 is operable over an angled lever 34 which carries a cam follower at its other end, cooperating with a cam on a control shaft 36. The free end of the portion 31 further includes a shoe or end piece 38 which is pivotable about a shaft 37. The free end of the shoe 38 is forked and the fork ends engage about a fixed pin 39, located in fixed position, for example by being secured to the frame (not shown) of the apparatus. As will be described below, shoe 38 will follow movement of the portion 31 in synchronism therewith, and in the same direction. Preferably, the shoe extends approximately about the width of the bottom plate 31 and, when bottom plate 31 is lifted, the bottom plate 31 and the shoe 38 form a trough or basket-shaped arrangement, as best seen in FIGS. 4 and 5, to retain a cop in the resulting hollow.

The ready or holding chamber 30 can be closed off by a cop ejector 40 which, essentially, extends from the front of the removal opening 19 and beneath the bottom portions 21, 23, 31. The ejector 40 is pivotably mounted to swing about an axis 41, and is actuated by a link system 42. Link system 42 is engageable with a further control cam 43 secured to the shaft 36. The ejector 40 is movable between various positions; FIG. 2 illustrates the rest position in which the holding chamber 30 is closed off. It is then movable in counterclockwise direction to the position shown in FIG. 3, and then back again through the rest position and towards the right, in clockwise direction, to an ejection position (FIGS. 4 and 5). Movement of the ejector 40 is controlled by suitable lands on the cam 43. The head of the ejector 40, the width of which corresponds approximately to the width of the bottom parts 31, 23, is preferably shaped with tines, or in rake form, so that it can pass through the bottom parts 31, 23 which, likewise, are formed like a grid or grate, so that the ejector and the bottom plate elements can respectively penetrate each other and the ejector can pass through the spaces formed between the grid or grate elements.

A blocking lever 50 penetrates, for example around or through, plate 22. Blocking lever 50 has a width which corresponds roughly to the width of the bin 14. It is located above the removal opening 19 and has a free inner end which projects inwardly of plate 22 by about the diameter of a cop. The blocking lever 15 thus defines with its inner end a pressure-free zone 60 within the bin 14 due to its projection thereinto. The pressure-free zone 60 is located above the removal opening 19. The blocking lever 50 is pivotably mounted to pivot about a fixed axis 51 and is actuated by a link and lever system 52 which is engaged with a further control cam 53 seated on the shaft 36.

The control paths of the cams 35, 43 and 53 generate synchronous movement of the bottom plate 31, the ejector 40 and the blocking lever 50 in synchronism with movement of the cop conveyor 15. Synchronous movement, from a drive (not shown) is schematically illustrated in FIG. 2 by broken line 36. The movement of the control cams on shaft 36 can be seen by reference to FIG. 6: Curve 61 illustrates movement of the spool ejector 40; curve 62 the movement of the bottom plate 31; curve 63 the movement of the locking lever 50; and curve 64 the continuous movement of a compartment 24 of the cop conveyor 15 past the removal opening 19. The subdivisions illustrated in FIG. 6 correspond to the positions taken by the mechanism in FIGS. 2–5, respectively.

Figure 6:
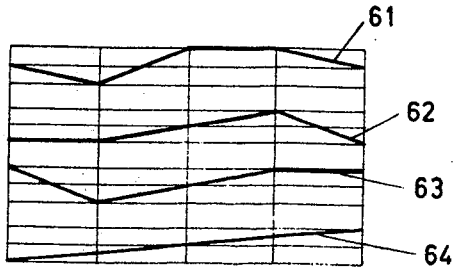
FIG. 6 is a graphic operating diagram of the operation of the various movable elements as shown in detail in FIGS. 2–5.

Operation, with reference to FIG. 6 and the sequence of FIGS. 2–5: The base position is illustrated in FIG. 2. The ejector 40 is located in advance of the ejection opening 19, it closes off the ready or holding chamber 30 and together with the bottom plates 21, 31 forms the bottom of the bin 14. A plurality of cops are located in the bin, the lowermost one being denoted *7a* and the next subsequent one *7b*. It is intended to remove the lowermost cop *7a* immediately in advance of the opening 19 from the stack or group of cops in the bin 14. A pressure-free zone 60 is formed above the cop *7a* due to the location of the blocking lever 50, which prevents collapse of the stack of cops immediately in advance of plate 22 and thus prevents pressure due to the weight of the stack of cops on the cop *7a*. As can be seen in FIG. 2, a compartment of the conveyor 15 has just been filled and the next subsequent compartment 24 is not yet in position to receive a new cop. It is just beginning its travel past the removal opening.

Shaft 36 rotates in synchronism with the cop conveyor. The cop conveyor is driven by a drive wheel 24', shown schematically and in broken form only, and the synchronous rotation — by way of connection 36' — causes movement of the cams on shaft 36 to change the position of the spool ejector 40 to a re-supply position. In this position, the holding or ready chamber 30 is released due to movement of the ejector 40 to a position below plate 31. Blocking lever 50 likewise has moved to a lower position so that it will be downwardly inclined. The lowermost spool or cop *7a* may thus slide into the holding chamber 30; the next subsequent cop *7b* as well as all the remaining cops are held away from the chamber 30, however, by the blocking lever 50. The bias force on flap 26 prevents movement of the cop *7a*, now in the holding or "ready" chamber 30 through the removal opening 19, since the next empty compartment 24 of the cop conveyor 15 is not yet in a position ready to receive the cop.

Upon further rotation, the system will change to the position of FIG. 4 in which the cop *7a*, now in the ready position, has been pushed through opening 19 counter the holding spring force of flap 26 into the empty compartment of the conveyor which has just arrived. The shape of the ejector 40, which is at least approximately as large as that of a cop, thereby closes off the opening and, additionally, closes off the ready or holding chamber 30. Preferably, and as shown in the figures, the ejector 40 has a shape corresponding roughly to the overall surrounding contour outline of two adjacently positioned cops, or possibly somewhat larger. The bottom plate 31, likewise, is lifted simultaneously with movement of the ejector 40. The shoe 38 likewise moves upon lifting of the plate 31. As a result, cops on the bottom plate 31 and on the shoe 38 are pushed slightly backwards, that is, towards the left in the drawing, and are pushed away from the direction of the removal opening, retaining the cops well spaced from the cop *7a* which has been ejected, as well as lifting the majority of the cops away from the next subsequent cop *7b* which is to be fed. Since the blocking lever 50 is also controlled (FIG. 6) to swing upwardly, it will lose contact with the lowermost cop *7b* so that it can move to the position shown in FIG. 4 above the removal opening 19 and somewhat above the ready chamber 30. Practically no force is exerted against the cop *7b* in this operation.

Movement of the bottom plate 31 as well as of shoe 38 and of blocking lever 50 continues until the extreme position shown in FIG. 5 is obtained.

Upon continued rotation of shaft 36, the ejector 40, the bottom plate 31 and the shoe 38 will return to the initial position shown in FIG. 2.

All movement of the various elements can be comparatively small, that is, over comparatively short distances only. Thus, with minimum movement, it is possible to prevent piling up of cops or pirns in advance of a removal opening. The movement itself can be relatively slow, and particularly the pivotal or rotary movement of bottom 31 and shoe 38 as well as the movement of the locking lever 50 can be gentle and smooth which prevents damage to even the finest of yarns or filaments on a cop, so that the filament windings on the cop are favored. The pressure-free zone 60 prevents contact with a substantial number of cops on the lowermost one of the cops to be fed. This was always the cop which was most highly stressed and damage resulted upon feeding of the cop when it was pressed together and surrounded by all other cops in the bin. The load-free or pressure-free zone 60 thus prevents practically all contact of the cop just being fed by subsequent or packed or stacked cops. The lowermost cop *7a* thus can be moved through the removal opening 19 without contact or influence of the subsequent cops in the bin, being moved only by the ejector 40, over a short distance and transverse to its longitudinal axis through opening 19 and into a compartment 24 of conveyor 15. Pile-up, jams, formation of bridges, and the like, in advance of the removal opening thus are effectively avoided.

The structure is simple and requires little by way of special materials or special constructions; it can be easily made.

Various changes and modifications may be made within the scope of the inventive concept.

I claim:

1. The combination of a supply bin (14) for textile cops and a feeder system to feed the cops, singly, to a removal station (24), and to separate the cops during the feeding operation to prevent pressure by cops in the supply bin on a cop *(7a)* being removed for feeding, having a bin structure having a removal opening (19) formed therein;

a biassed flap (26) releasably closing the removal opening, and ejection means (40) engageable with the lowermost cop to feed the cop to the removal means, wherein, in accordance with the invention, at least a portion of the bottom of the supply bin structure (14) is inclined forwardly towards the removal opening (19) and includes a movable base plate (31), the base plate being mounted for movement between a feed position in which the base plate is inclined in the direction of inclination of the bottom of the supply bin and towards the opening, and a re-supply position in which the base plate is inclined upwardly and away from the removal opening (19);

and the ejection means comprises a movable ejector (40) occupying a space at least approximately of the size of the geometric outline of a cop, said ejector element (40) being mounted for movement between a rest position in which the ejector element is located immediately in advance of the cop removal opening (19) and closes off said opening, a re-supply position in which the ejector element (40) is located in a position beneath the bottom of the supply bin (14), and a feed position in which the ejector (40) is engaging a cop *(7a)* to feed said cop in advance thereof, along the downwardly inclined bottom of the supply bin and pushing said cop against said biassed flap (26) and through said removal opening.

2. Combination according to claim 1, wherein said ejector element (40) is pivotally mounted, and said movement between said three positions is a pivoting movement.

3. Combination according to claim 1, wherein a portion of the bottom of the supply bin located in advance of the removal opening is defined by a downwardly set off or stepped bottom portion (23).

4. Combination according to claim 1, wherein the ejector element (40) is formed with rakes or tines, said ejector element occupying the space (30) immediately in advance of the ejection opening (19) when the ejector element is in rest position, and the bottom of the supply bin (14) is formed with a grid or grate-like structure with the solid portions of the grate-like structure offset with respect to the solid portions of the rake structure of the ejector element to permit penetration of the ejector element through said grate structure.

5. Combination according to claim 1, wherein the ejector element is mounted for sequential movement through its positions in this sequence: re-supply position; rest position; feed position; the ejector, upon movement between between rest position and feed position closing off the space immediately in advance of the ejector opening to prevent pressure on the cop *(7a)* being ejected by the ejector caused by other cops located in the bin.

6. Combination according to claim 1, further comprising a blocking lever (50) located above the ejection opening (19) and extending into the bin structure (14), said blocking lever being movable between a position close to the ejection opening and a raised position to push cops in the vicinity of the ejection opening away from the ejection opening.

7. Combination according to claim 6, wherein the blocking lever is a plate-like element extending transversely of the bin and having a length approximately similar to that of a cop in the bin, said blocking lever plate (50) being mounted for pivotal movement.

8. Combination according to claim 1, further comprising a lifting shoe located adjacent the free end of the movable base plate (31) and positioned to extend upwardly from the movable base plate to hold cops on the movable base plate away from the ejection opening (19).

9. Combination according to claim 8, wherein said shoe is movable conjointly with movement of the movable base plate.

10. Combination according to claim 1, further comprising a conveyor (15, 24), and a synchronized drive (36') synchronizing drive of the conveyor and movement of said base plate (31) and said ejector element (40).

11. Combination according to claim 6, further comprising a conveyor (15, 24), and a synchronized drive (36') synchronizing drive of the conveyor and movement of said base plate (31), said ejector element (40) and said blocking lever (50).

12. Combination according to claim 4, further comprising a blocking lever (50) located above the ejection opening (19) and extending into the bin structure (14), said blocking lever being movable between a position close to the ejection opening and a raised position to push cops in the vicinity of the ejection opening away from the ejection opening;

a lifting shoe located adjacent the free end of the movable base plate (31) and positioned to extend upwardly from the movable base plate to hold cops on the movable base plate away from the ejection opening (19);

and a conveyor (15, (24), and a synchronized drive (36') synchronizing drive of the conveyor and movement of said base plate (31), said ejector element (40), said blocking lever (50) and said shoe (38).

* * * * *